United States Patent [19]

Shaner

[11] Patent Number: 4,946,634

[45] Date of Patent: Aug. 7, 1990

[54] POWDER COMPACTING PRESS TO CONTROL GREEN DENSITY DISTRIBUTION IN PARTS

[75] Inventor: Kenneth H. Shaner, Towanda, Pa.

[73] Assignee: GTE Products Corporation, Stamford, Conn.

[21] Appl. No.: 252,719

[22] Filed: Oct. 3, 1988

Related U.S. Application Data

[63] Continuation-in-part of Ser. No. 39,032, Apr. 16, 1987, abandoned, which is a continuation-in-part of Ser. No. 731,221, May 7, 1985, abandoned.

[51] Int. Cl.[5] ..... B22F 3/02

[52] U.S. Cl. ..... 264/40.5; 264/109; 425/78; 425/149

[58] Field of Search ..... 425/78, 145, 149, 261, 425/256, 347, 352, 140; 264/40.4, 40.5, 56, 109; 364/476, 477

[56] References Cited

U.S. PATENT DOCUMENTS

| | | | |
|---|---|---|---|
| 3,910,737 | 10/1975 | Shimada et al. | 425/141 |
| 4,030,868 | 6/1977 | Williams | 425/149 |
| 4,100,598 | 7/1978 | Stiel et al. | 425/352 |
| 4,413,967 | 11/1983 | Burry | 425/149 |

FOREIGN PATENT DOCUMENTS

| | | | |
|---|---|---|---|
| 57-206597 | 12/1982 | Japan | 264/40.5 |
| 59-128000 | 7/1984 | Japan | 425/78 |
| 05743 | 10/1986 | PCT Int'l Appl. | 364/476 |

*Primary Examiner*—Jill L. Heitbrink

*Attorney, Agent, or Firm*—Donald R. Castle; L. Rita Quatrini

[57] ABSTRACT

A powder compacting press wherein one or more upper and one or more lower punches are respectively advanced toward each other in a die filled with an amount of powder to producing a pressed part in the shape of the die and punch configuration. The press including measuring device on the upper and lower punches to measure the peak forces applied to the upper and the lower punches and to generate a first signal proportional to the forces, calculating device for receiving the first signal and calculating the ratio of the forces of the upper and lower punches and transmitting a second signal that is proportional to the ratio, and adjusting device for receiving the second signal and adjusting the forces applied to each punch based upon the second signal to achieve a predetermined green density distribution in the pressed part whereby substantial uniformity in part dimensions is achieved.

6 Claims, 1 Drawing Sheet

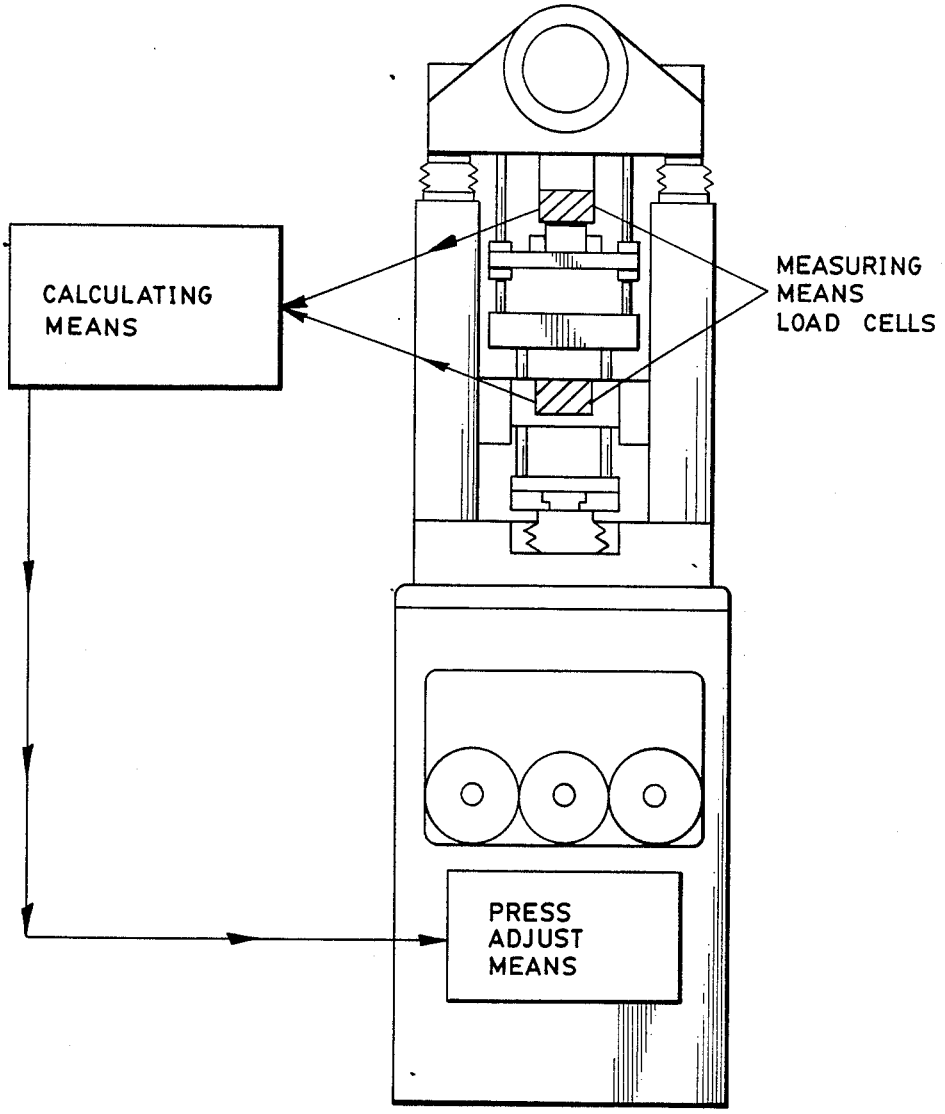
CALCULATING MEANS
MEASURING MEANS LOAD CELLS
PRESS ADJUST MEANS

POWDER COMPACTING PRESS TO CONTROL GREEN DENSITY DISTRIBUTION IN PARTS

This application is a continuation-in-part of application Ser. No. 039,032 filed Apr. 16, 1987 now abandoned and entitled "Improvement In A Power Compacting Press To Control Green Density Distribution In Parts", which is a continuation-in-part of application Ser. No. 731,221, filed May 7, 1985 now abandoned and entitled "Improvement In A Power Compacting Press To Control Green Density Distribution in Parts.

FIELD OF THE INVENTION

This invention relates to an improvement in a powder compacting press by which the green density distribution in parts is controlled.

BACKGROUND OF THE INVENTION

In the manufacturing of parts in a powder compacting press, the parts within a particular lot must be periodically checked in an attempt to maintain the desired green density distribution. This is done by sintering to final density and observing the final shape of the part. If the parts are unsatisfactory with respect to green density distribution as indicated by incorrect dimensions of the sintered parts, adjustments must be made on the press to adjust the pressure which is applied to the powder.

This checking and adjusting method is time consuming and costly and is subject to error. As a result, there is a high rejection rate of parts.

Therefore, an improvement by which the green density distribution of parts can be controlled without the above disadvantages would be highly desirable and an advancement in the art.

U.S. Pat. No. 4,100,598 to Stiel et al relates to compressive force detection. This patent relates to shallow die fill parts on a rotary press. The average green density is controlled.

U.S. Pat. No. 4,413,967 to Burry relates to measurement of peak force on a punch and this varies with the weight of the material. This measurement does not take into account the changes in force that come about because of changes in the die fill.

By following Stiel and Burry, one cannot make a precision sintered part of sufficient accuracy.

U.S. Pat. No. 3,910,737 to Shimada et al teaches use of an external weight apparatus for correcting weight in a powder compacting press. However, Shimada does not teach precise control of the density distribution, nor does it relate to use of two or more load cells.

U.S. Pat. No. 4,030,868 to Williams discloses a piezoelectric force transducer positioned in a powder compacting wherein the measured forces are correlated to the tablets' weight to control the punch positioning means. Williams teaches use of only one punch.

Japanese Patent 57-206,597 relates to measuring forces on upper and lower punches, but there is no teaching of computing the ratios of the forces to control density distribution.

The above references do not take into account all of the forces, even the peak forces on the part which are necessary to accurately predict and control the green density distribution in a sintered part.

SUMMARY OF THE INVENTION

In accordance with one aspect of the invention, there is provided an improvement in a powder compacting press wherein one or more upper and one or more lower punches are respectively advanced toward each other in a die filled with an amount of powder to produce a pressed part in the shape of the die and punch configuration. The improvement comprises measuring means on the upper and lower punches to measure the peak forces applied to the upper and the lower punches and to generate a first signal proportional to the forces, calculating means for receiving the first signal and calculating the ratio of the forces of the upper and lower punches and transmitting a second signal that is proportional to the ratio, and adjusting means for receiving the second signal and adjusting the forces applied to each punch based upon the second signal to achieve a predetermined green density distribution in the pressed part whereby substantial uniformity in part dimensions is achieved.

BRIEF DESCRIPTION OF THE DRAWING

The FIGURE is a diagram of an improvement in a powder compacting press in accordance with one aspect of this invention.

DETAILED DESCRIPTION OF THE INVENTION

For a better understanding of the present invention, together with other and further objects, advantages and capabilities thereof, reference is made to the following disclosure and appended claims in connection with the above described drawing and description of some of the aspects of the invention.

The FIGURE is a diagram which shows an improvement in a powder compacting press, which includes a press to which is attached measuring means, the preferred measuring means being load cells which are connected to a calculating means which is connected to an adjusting means. The press has one or more upper and one or more lower punches which in operation are respectively advanced toward each other in a die which is filled with powder to produce a part wich is pressed in the shape of the die and punch configuration.

The preferred presses are mechanical withdrawal type presses and opposed ram presses with mechanical withdrawal type presses being especially preferred and which will be used to illustrate the preferred embodiment of this invention.

In a preferred embodiment of this invention, the die fill or weight of powder to be pressed is controlled by adjusting the lower punch or punches to a position in the die to a depth corresponding to the desired weight of the powder. In the pressing operation, one or more upper punches enters the die a predetermined distance and stops. This is commonly called upper punch entry. Due to die wall friction and bridging, a larger amount of force is applied to the powder in the upper part of the die than in the lower part of the die and the pressing is primarily from the top. Next, the lower punch advances a predetermined distance into the die and stops. Due to die wall friction and bridging, the pressing is primarily from the bottom. Now the upper punch advances an additional distance and the pressing is again primarily from the top. This motion is typically called the "prepress" or "postpress". After the additional downward force has been applied, the powder is under maximum or peak forces from the upper and lower punches to form the pressed parts. The control of where these various motions stop controls the density distribution within the part. These motions are interactive with routine press adjustments EGC diefill upon formation of the part, the forces are released on the part.

The measuring means measures the peak forces applied to the upper and the lower punches and generates a first signal which is proportional to the peak forces. The peak forces can be measured by any standard means such as a pressure transducer or load cells. The preferred measuring means are load cells. The load cells are connected to the punches with one load cell being connected to the upper punch or punches and the other load cell or cells being connected to the lower punch or punches. The load cells are machined to accept the punch. In general, the load cells can be connected to the punches by any standard means such as by fastening them to the punches by bolts. The load cells are preferably made of a high grade of stainless steel so that they will be of sufficient hardness to withstand the pressing operation.

To produce parts of the desired green density distribution, that is, parts of the desired shape after sintering to final density, one or more test parts of the desired weight are generally first pressed according to the procedure described previously under conditions of force which are believed to give the desired green density distribution. The parts are then sintered to produce the final densified part. This test procedure is carried out until the sintered parts have the desired shape and dimensions. This testing is done only initially and does not have to be done again throughout the processing of a particular lot; nor does it have to be done in the future for material having the same general chemical composition and particle size range as has had to be done prior to this invention. While the above is true in all cases, in those cases where the finished part is symmetrical with the die, the ratio may be calculated thus elimating the need for a pretest.

At this point, the relationship of the ratio of the peak forces of the upper and lower punches and the green density distribution is determined preferably by means of an algorithm.

This relationship having been determined for a particular type of powder is now used to control the green density distribution in subsequent pressed parts as will now be described using the improvement of this invention.

The calculating means receives the first signal generated by the measuring means. The calculating means then calculates the ratio of the peak forces of the upper and lower punches by the relationship which has been predetermined as described previously. The calculating means then transmits a second signal which is proportional to the ratio. The calculating means can be electromechanical means or electronic means such as a computer. The preferred calculating means is a computer.

The adjusting means which is connected to the calculating means receives the second signal from the calculating means. The adjusting means is connected to the prepress adjustment in a mechanical withdrawal type of press and to the rate adjustment on an opposed ram type of press. The preferred adjusting means is an electropneumatic device. The adjusting means adjusts the forces applied to each punch based on the second signal to achieve the desired predetermined green density distribution in the pressed part.

Any pertinent information can be displayed on a monitor which is connected to the calculating means, for the information of the operator.

The powder which is pressed can be any powder in actuality. The powder used in the preferred application of this invention is a metal powder which can be, for example, tungsten carbide containing varying amounts of cobalt.

Other preferred powders are ceramic materials such as silicon nitride, aluminum oxide, sialons, silicon carbide, and mixtures thereof. The parts pressed therefrom have a green density of from about 50% to about 60% of the theoretical density and are sintered to a density of greater than about 98% of the theoretical density.

By the improvement described herein, parts are pressed of desired green density distribution and they are therefore sintered to the desired final shape. Furthermore, by the continual adjustment of the ratio of the peak forces afforded by the adjustment of the prepress by the adjusting means, the quality of the parts is being continually monitored and controlled so that there is substantial improvement in part dimensions.

While there has been shown and described what are at present considered the preferred embodiments of the invention, it will be obvious to those skiled in the art that various changes and modifications may be made therein without departing from the scope of the invention as defined by the appended claims.

What is claimed is:

1. An improvement in a process for compacting powder in a powder compacting press wherein one or more upper and one or more lower punches are respectively advanced toward each other in a die filled with an amount of powder to produce a pressed part in the shape of said die and punch configuration, the improvement comprising:

(a) measuring the peak forces applied to said upper and lower punches and generating a first signal proportional to said forces;

(b) receiving said first signal with calculating means and calculating the ratio of said forces of said upper and said lower punches with said calculating means and transmitting a second signal proportional to said ratio; and (c) receiving said second signal with adjusting means and adjusting the forces applied to each punch based upon said second signal with said adjusting means to achieve a predetermined green density distribution in said pressed part whereby substantial uniformity in part dimensions is achieved.

2. A process of claim 1 wherein the improvement includes said measuring means being load cells.

3. A process of claim 1 wherein the improvement includes said part being made of tungsten carbide with cobalt.

4. A process of claim 1 wherein the improvement includes said part being made of ceramic material selected from the group consisting of silicon nitride, aluminum oxide, sialons, silicon carbide, and mixtures thereof.

5. In a powder compacting press wherein one or more upper and one or more lower punches are respectively advanced toward each other in a die filled with an amount of powder to produce a pressed part in the shape of said die and punch configuration, the improvement comprising:

(a) measuring means on said upper and lower punches to measure the peak forces applied to said upper and said lower punches and to generate a first signal proportional to said forces;

(b) calculating means for receiving said first signal and calculating the ratio of said forces of the upper and lower punches and transmitting a second signal that is proportional to said ratio; and (c) adjusting means for receiving said second signal and adjusting the forces applied to each punch based upon said second signal to achieve a predetermined green density distribution in said pressed part whereby substantial uniformity in part dimensions is achieved.

6. A press of claim 5 wherein the improvement includes said measuring means being load cells.

* * * * *